US006623189B2

(12) United States Patent
Ansell et al.

(10) Patent No.: US 6,623,189 B2
(45) Date of Patent: Sep. 23, 2003

(54) PRINTING DEVICE WITH TRANSVERSE GUIDE FOR OFFSETTING A PRINT HEAD TRANSVERSELY WITH RESPECT TO THE PRINTING DIRECTION

(75) Inventors: Iain Ansell, Newmarket Suffolk (DE); Steven Roland Brace, Cambridgeshive (DE)

(73) Assignee: Francotyp-Postalia AG & Co., Birkenwerder (DE)

( * ) Notice: Subject to any disclaimer, the term of this patent is extended or adjusted under 35 U.S.C. 154(b) by 0 days.

(21) Appl. No.: 09/793,413

(22) Filed: Feb. 26, 2001

(65) Prior Publication Data

US 2001/0053302 A1 Dec. 20, 2001

(30) Foreign Application Priority Data

Feb. 24, 2000 (DE) ..... 100 09 801

(51) Int. Cl.[7] ..... B41J 25/304

(52) U.S. Cl. ..... 400/76; 400/283; 400/355; 101/71

(58) Field of Search ..... 400/76, 23, 320, 400/352, 354, 355, 283, 59, 319; 347/9, 37; 101/371, 71

(56) References Cited

U.S. PATENT DOCUMENTS

| | | | | | |
|---|---|---|---|---|---|
| 2,651,400 | A | * | 9/1953 | Young et al. | 197/2 |
| 3,583,540 | A | * | 6/1971 | Bernard | 346/134 |
| 4,545,695 | A | * | 10/1985 | Agata | 400/31 |
| 4,774,529 | A | | 9/1988 | Paranjpe et al. | |
| 4,930,911 | A | * | 6/1990 | Sampson et al. | 101/27 |
| 5,762,428 | A | * | 6/1998 | Cordery et al. | 400/124.04 |
| 5,947,614 | A | * | 9/1999 | Shoji et al. | 400/23 |
| 6,099,107 | A | * | 8/2000 | Ford et al. | 347/104 |
| 6,447,183 | B2 | * | 9/2002 | Ford | 400/320 |
| 6,478,403 | B1 | * | 11/2002 | Giles et al. | 347/37 |
| 2002/0001496 | A1 | * | 1/2002 | Ford | 400/76 |

FOREIGN PATENT DOCUMENTS

| | | |
|---|---|---|
| DE | 31 25 426 A1 | 1/1983 |
| DE | 42 37 275 C1 | 11/1993 |
| DE | 198 22 423 A1 | 11/1999 |
| EP | 0 748 693 A1 | 12/1996 |
| EP | 0 933 210 A2 | 8/1999 |
| EP | 0 958 926 A2 | 11/1999 |
| EP | 0 980 761 A1 | 2/2000 |
| EP | 0 980 762 A2 | 2/2000 |

* cited by examiner

*Primary Examiner*—Leslie J. Evanisko
*Assistant Examiner*—Kevin D Williams
(74) *Attorney, Agent, or Firm*—Laurence A Greenberg; Werner H. Stemer; Gregory L. Mayback

(57) ABSTRACT

A printing device is described that has a print head held displaceably on a print-head holder. To achieve a relative movement between the print head and a medium to be printed, the print-head holder is configured such that during printing it can be moved in a first line with respect to a base element, between a first longitudinal position and a second longitudinal position. An offsetting device is provided which permits a printing of images offset from one another transversely with respect to an imaginary line and which is configured to offset the print head relative to the print-head holder from a first transverse position into at least a second transverse position spaced apart from the first transverse position, transversely with respect to the imaginary line.

14 Claims, 8 Drawing Sheets

PRINTING DEVICE WITH TRANSVERSE GUIDE FOR OFFSETTING A PRINT HEAD TRANSVERSELY WITH RESPECT TO THE PRINTING DIRECTION

BACKGROUND OF THE INVENTION

Field of the Invention

The invention relates to a printing device, in particular to a franking and/or addressing machine, with a print head which is held displaceably on a print-head holder. In order to achieve the relative movement between a print head and a medium to be printed, the print-head holder is configured such that, during printing, it can be moved along a first line with respect to a base element, between a first longitudinal position and a second longitudinal position. In addition, a first offsetting device is provided which permits the printing of printed images offset from one another transversely with respect to the first line. The first offsetting device is configured to offset the print head relative to the print-head holder from a first transverse position into at least a second transverse position spaced apart from the first transverse position transversely with respect to the first line. In this case, the first offsetting device contains at least a first guide device with a first guide face and at least a second guide device with a guide element which cooperate, with mutual relative movement, in order to offset the print head from the first into the second transverse position by moving the print-head holder along the first line.

In the sense of the present invention, the term print head designates all types of printing devices which are able to produce a printed image on a medium. In other words, the term includes printing devices using any desired printing techniques. Nor is it intended to be restricted to the component which produces the printed image directly but, in addition, can contain further components which are needed to produce printed images. These may be, for example, ink storage containers, etc.

A generic device is disclosed for example by Published, European Patent Application EP 0 980 761 A1. In the device described there, the print head is disposed displaceably in a holder guided by a guide rod. For the purpose of printing, the holder, and therefore the print head, is moved along a first line, namely parallel to the guide rod.

Once a first printed image has been produced, the print head is offset relative to the holder at right angles to the first line, in order, in a second step, to produce a second printed image while moving the print head in the opposite direction along the first line. The offset of the second printed image in relation to the first printed image is so great that the two printed images overlap at most in the marginal area in which they adjoin each other transversely with respect to the first line. This makes it possible to use one print head to produce an overall printed image whose dimension transversely with respect to the first line, that is to say transversely with respect to the printing direction, corresponds approximately to twice the printing width of the print head.

In the known device, the offsetting device is implemented by a pin which is disposed on the underside of the print head and which, in order to offset the print head transversely with respect to the first line, is guided in a groove in the base element. The groove runs at an angle to the first line, so that in the event of relative movement between the pin and the groove along the first line, the offsetting movement of the print head at right angles to the first line is produced.

This configuration is associated with the disadvantage that the groove is relatively complicated to produce, since particularly close tolerances have to be complied with in order to achieve the desired transverse offset exactly. A further disadvantage resides in the fact that subsequent adjustment is impossible.

SUMMARY OF THE INVENTION

It is accordingly an object of the invention to provide a printing device with a transverse guide for offsetting a print head transversely with respect to the printing direction which overcomes the above-mentioned disadvantages of the prior art devices of this general type, which requires little outlay, and permits rapid, high-quality printing.

With the foregoing and other objects in view there is provided, in accordance with the invention, a printing device. The printing device contains a base element, a print head, and a print-head holder displaceably holding the print head. In order to achieve a relative movement between the print head and a medium to be printed, the print-head holder is configured such that during printing the print-head holder can be moved along an imaginary line between a first longitudinal position and a second longitudinal position positioned above the base element. An offsetting device is provided and permits the printing of printed images offset from one another transversely with respect to the imaginary line. The offsetting device is configured to offset the print head relative to the print-head holder from a first transverse position to a second transverse position spaced apart from the first transverse position, and transversely with respect to the imaginary line. The offsetting device includes a first guide device with a first guide face and a second guide device with a guide element which cooperate, with mutual relative movement, in order to offset the print head from the first transverse position to the second transverse position by moving the print-head holder along the imaginary line. The guide element of the second guide device is disposed on the base element.

The invention is based on the technical teaching that a particularly cost-effective and easily implemented printing device is obtained if the guide element of the second guide device is disposed on the base element. Such a guide element disposed on the base element may be produced considerably more simply than the known guide groove.

For example, it can be formed simply by a simple guide pin with a circularly cylindrical operative face.

Furthermore, it is straightforwardly possible to adjust the guide element subsequently. For example, it can be disposed on the base element such that it can be adjusted transversely with respect to the first line. In addition, in order to achieve the positional adjustment, it is possible to configure the second guide device in the manner of an eccentric. For example, a guide pin with a circularly cylindrical operative face may be fixed such that it can be rotated about an axis located eccentrically.

The term guide device in the sense of the present invention includes any desired devices which, when they cooperate with an opposing part like the guide element according to the invention, influences the direction of the relative movement between the guide device and the opposing part.

In this case, the first guide device acts on the print head. For this purpose, it can be disposed directly on the print head. Alternatively, it can also be disposed on the print-head holder and act on the print head via appropriate operative elements for offsetting the latter.

In variants of the invention which are preferred, because they are simple to configure, the first guide device has at least a first guide face and the second guide device is formed by a guide element which cooperates with the first guide face in order to offset the print head. The first guide face is swept over by the guide element as the guide devices cooperate. In this case, the guide element can have a second guide face, over which the operative partner sweeps during the cooperation of the guide devices. However, it is likewise possible for the guide element to be configured such that a line or point contact with the first guide face results.

Provided that the contact, that is to say the action of a contact force, between the two guide devices is ensured, a defined movement of the print head during offsetting is also ensured. The contact force can be ensured, for example, by a spring acting on the print head.

The first guide device is preferably formed by a guide groove and the second guide device by a guide pin, since in this case the result is a configuration which is particularly simple to produce and provides reliable guidance. In addition, such a configuration ensures positive guidance, which also permits reliable guidance without any special prestressing of the two guide devices against each other. Preferably the guide pin has a circularly cylindrical operative face.

The first guide face runs at an angle to the first line. The course of the inclination of the first guide face, in particular of the guide groove, in relation to the first line can also be matched to the course of the contact force between the guide devices. This force may change over the offsetting movement, in particular in variants in which prestressing of the two guide devices against each other by a spring or the like is provided, which deforms more and more with continued transverse offset of the print head and therefore has the effect of a changing contact force between the two guide devices. Matching the inclination can be carried out with the effect that specific normal and/or tangential force limits in the contact area between the two guide devices are not exceeded. In this way, the wear on the guide devices can be kept low.

In preferred variants of the device according to the invention, the guide groove has a substantially V-shaped or Y-shaped course. This permits a reversal of direction along the first line as the print head is offset transversely with respect to the first line. This reduces influences of this reversal of movement on the accuracy of the offset. These influences may occur during the desired rapid movement through the offset region against the background of the fastest possible printing operation, because of an abrupt reversal of movement. As a result of the guidance further ensured after the reversal of movement in this configuration, such influences are reduced to a minimum. In addition, it goes without saying in this case that the limbs of the guide groove do not absolutely necessarily have to be configured to be rectilinear. They can also have a curved course.

The limbs of the V-shaped or Y-shaped guide groove are preferably disposed at an angle to the first line. This reduces the movement travel needed for the transverse offset of the print-head holder along the first line, which in turn has an advantageous effect on the overall size of the device. It is preferable for limbs of the guide groove to run substantially symmetrical to an axis parallel to the first line, since in this case, given a predefined inclination of the limbs to the first line, the shortest movement travel needed for the transverse offset is achieved.

In the transition region of the limbs of the guide groove, a guide device is then provided to ensure the offsetting movement from the first into the second transverse position. The guide device is configured such that, following the reversal of movement, the guide element passes through that region of the guide groove through which it has not yet traveled. This reliably rules out the situation where, following the reversal of movement, unintended resetting to the initial position takes place in that it is not the further course of the guide groove which is passed through, but that region of the guide groove which has just been passed through but is now passed through again in the opposite direction.

In this case, the guide device preferably contains a diverter device which is configured to close the first limb of the guide groove and open the second limb of the guide groove after passing the diverter device.

It is preferable for the guide device disposed on the base element and belonging to the first offsetting device to be disposed in the region of the first or second longitudinal position of the print-head holder, in order to permit the transverse offsetting of the print head directly after reaching the first or second longitudinal position of the print-head holder. This ensures the lowest possible overall height of the device and, also reduces the overall printing time because of the short paths to be traveled.

In preferred configurations of the device according to the invention, at least a second offsetting device is provided to offset the print head from the second into the first transverse position. This permits circulatory operation of the device, that is to say in order to reach the initial position of the print head, it is not necessary to travel through the offsetting device in the opposite direction.

The second offsetting device can be formed by a simple spring and a triggering device which resets the print head into the first transverse position, that is to say its initial position transverse to the first line, following the actuation of the triggering device.

In this case, the second offsetting device is preferably configured to offset the print head from the second into the first transverse position by moving the print-head holder along the first line, which also renders a separate drive superfluous.

In beneficial developments, the second offsetting device operates on the same principle as the first offsetting device. The second offsetting device preferably contains at least a third guide device. The third guide device is further preferably configured to cooperate with at least one of the guide devices of the first offsetting device, so that the provision of a separate guide device cooperating with the third guide device is rendered superfluous.

In advantageous variants, a guide device belonging to the first offsetting device is disposed on the base element in the area of the first longitudinal position of the print-head holder, and the third guide device is disposed on the base element in the area of the second longitudinal position of the print-head holder. Alternatively, a guide device belonging to the first offsetting device is disposed on the base element in the area of the second longitudinal position of the print-head holder, and the third guide device is disposed on the base element in the area of the first longitudinal position of the print-head holder. In both variants, the lowest possible overall size of the device is ensured. Further, the overall printing time is also reduced, because of the short paths to be traveled.

As a result of the configuration according to the invention, a separate drive for offsetting the print head transversely is dispensed with. Instead, the drive for moving the print head during printing is also used as a drive for the offsetting device.

By using simple guide devices that can be moved relative to one another, first, the outlay on construction for an appropriate device is reduced. Second, the mass of the printing unit, containing the print head and the print-head holder, which has to be moved during printing is also reduced, since the printing unit only bears on one of the guide devices. This in turn has a positive effect on the accelerations that can be achieved during high-quality printing, and therefore the achievable printing speed.

In accordance with an added feature of the invention, the second guide device is disposed on the base element such that its position can be adjusted transversely with respect to the imaginary line.

In accordance with an additional feature of the invention, in order to achieve a positional adjustment, the second guide device is configured as an eccentric.

In accordance with another feature of the invention, the second guide device is disposed on the base element in an area of one of the first longitudinal position and the second longitudinal position of the print-head holder.

In accordance with a further feature of the invention, a further offsetting device for offsetting the print head from the second transverse position to the first transverse position is disposed on the base element.

In accordance with another added feature of the invention, the offsetting device is configured to offset the print head from the first transverse position to the second transverse position by moving the print-head holder along the imaginary line.

In accordance with another additional feature of the invention, the further offsetting device contains a third guide device.

In accordance with another further feature of the invention, the third guide device is configured to cooperate with the first guide device belonging to the offsetting device.

In accordance with a concomitant feature of the invention, the printing device is a franking machine.

Other features which are considered as characteristic for the invention are set forth in the appended claims.

Although the invention is illustrated and described herein as embodied in a printing device with a transverse guide for offsetting a print head transversely with respect to the printing direction, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
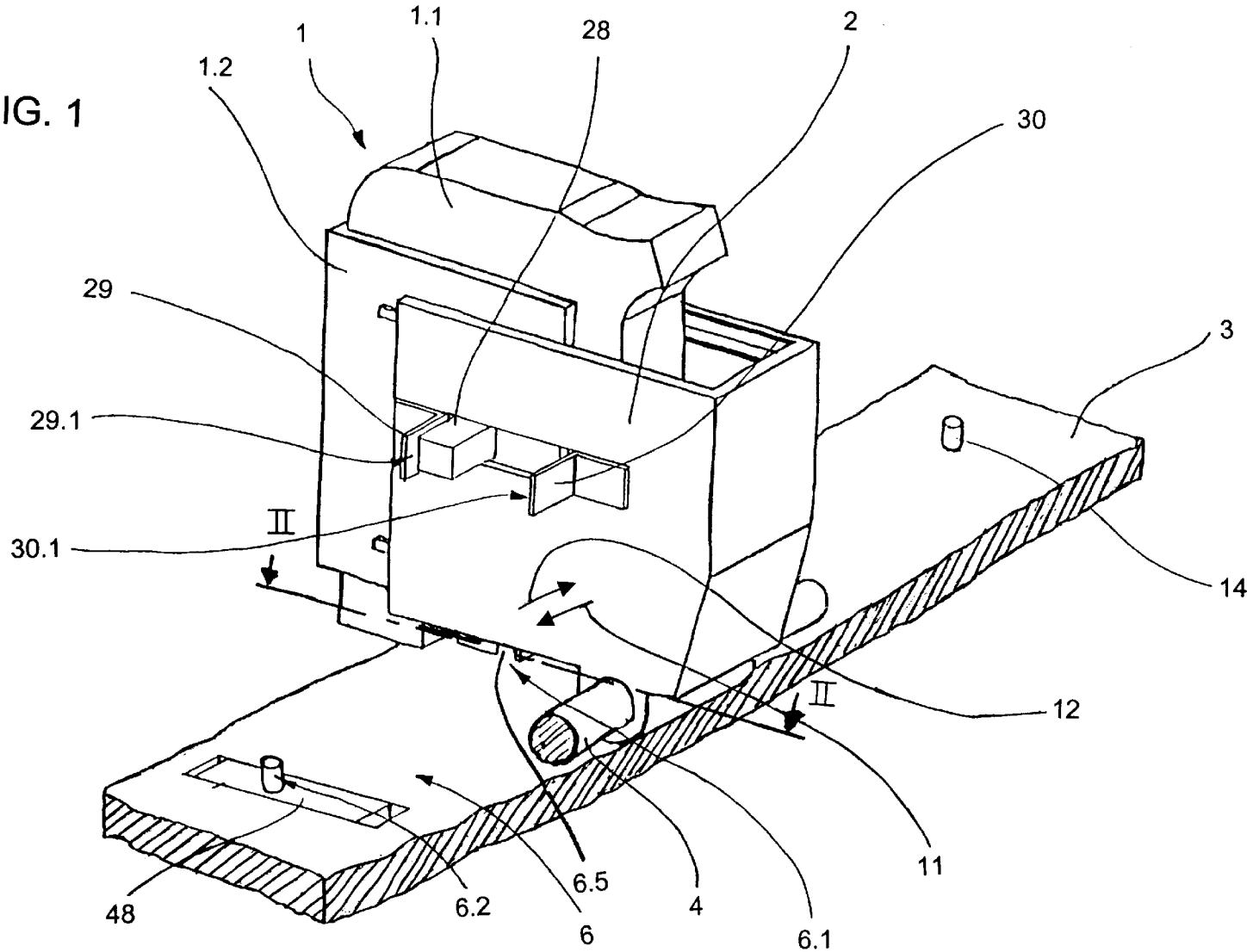
FIG. 1 is a diagrammatic, perspective partial view of a preferred exemplary embodiment of a printing device according to the invention.

In all the figures of the drawing, sub-features and integral parts that correspond to one another bear the same reference symbol in each case. Referring now to the figures of the drawing in detail and first, particularly, to FIG. 1 thereof, there is shown a partial view of a franking machine having a print head 1, which is held displaceably on a print-head holder 2. The print head 1 contains an ink jet cartridge 1.1, which is replaceably mounted in a shell 1.2. The shell 1.2 is mounted displaceably in the print-head holder 2.

During printing, the print-head holder 2 is moved along a first line with respect to a base element 3 between a first longitudinal position and a second longitudinal position, which performs a relative movement between the print head 1 and a medium to be printed (not illustrated). In this case, it is guided by a guide rod 4, of which only a section is shown.

The print head 1 is mounted in the print-head holder 2 via the shell 1.2 such that it can be displaced transversely with respect to the first line.

Also provided is a first offsetting device 6. This is used to offset the print head 1 relative to the print-head holder 2 from a first transverse position into a second transverse position spaced apart from the first transverse position transversely with respect to the first line. This makes it possible to print printed images that are offset from one another transversely with respect to the first line.

The first offsetting device 6 is formed by a first guide device 6.1 and a second guide device 6.2. The first guide device contains a guide groove 6.5 which is formed on the underside of the shell 1.2. The second guide device contains a guide pin 6.2, which is disposed on the base element 3 and can run in the guide groove 6.5.

As can be gathered from FIG. 2, the guide groove 6.5 and the guide pin 6.2 cooperate in the following manner as the print-head holder 2, and therefore the print head 1, is moved along the first line, with mutual relative movement in order to offset the print head 1 transversely with respect to the first line.

The guide groove 6.5 has a course at an angle to the first line. With its side walls, it provides a first guide face 8, against which the guide pin 6.2 runs as it moves in a direction of the arrow 11 along the first line.

Because of the inclination of the guide face 8 with respect to the first line, the shell 1.2 in which the guide groove 6.5 is formed, moves transversely with respect to the first line. As the print-head holder 2 moves further, the print head 1 is also offset from its first transverse position, transversely with respect to the first line.

Once the guide pin 6.2 has traveled through the guide groove 6.5, and once the transverse offset to be completed has therefore been achieved, as illustrated by the dashed contour 1.3, the direction of movement along the first line is reversed, that is to say the print-head holder 2 is moved in the direction of an arrow 12.

The guide pin 6.2 is disposed in the area of the first longitudinal position of the print-head holder 2, so that the transverse offsetting of the print head 1 can be carried out immediately after the completion of a printed image or before the beginning of the printed image.

In order to offset the print head 1 back from the second transverse position into the first transverse position, a second offsetting device is provided in the area of the second longitudinal position of the print-head holder 2. The second offsetting device is formed by a third guide device in the form of a second guide pin 14, which in its turn can run in a second guide groove 6.3 on the underside of the shell 1.2.

The guide groove 6.3 has a guide face 15 against which the guide pin 14 runs when the print head 1 is moved further in the direction of the arrow 12, as becomes clear from contour 1.4. Here, too, the offsetting of the print head 1 takes place as a result of the inclination of the guide face 15 to the first line, as a result of moving the print-head holder 2 along the first line. In this way, the shell 1.2, in which the guide groove 6.3 is formed, is moved transversely with respect to the first line and toward the guide rod 4 during the further movement of the print-head holder 2 in the direction of the arrow 12, whereby the print head 1 is also offset from its second transverse position, transversely with respect to the first line.

Once the guide pin 14 has traveled through the guide groove 6.3, and once the transverse offset to be completed has therefore been achieved, as illustrated by the dashed contour 1.5, the direction of movement can be reversed again, that is to say the print-head holder 2 can be moved in the direction of the arrow 11 again.

During the offsetting of the print head 1, the guide grooves 6.5 and 6.3 ensure positive guidance of the print head 1, so that the latter is located in a more or less accurately defined position at any time, depending on the play between guide pin and guide groove. However, it goes without saying that, in other variants of the invention, instead of the guide grooves, other guide devices can also be provided. For example, it may be sufficient, instead of the guide grooves, to provide only a web which is similar to a web 6.4 between the guide grooves 6.5 and 6.3 and which provides the corresponding guide faces.

Likewise, the guide element or elements of the second or third guide device 6.2, 14 do not necessary have to have the form of a cylindrical guide pin. Any other desired geometries are possible which cooperate with the guide faces of the first guide device in an appropriate way.

In order to hold the print head 1 in its first or second transverse position during printing, that is to say while traveling between the first and second longitudinal position and vice versa, holding devices are provided.

These are formed by a magnet 28 and two angled plates 29 and 30 made of magnetic metal. The magnet 28 is joined to the shell 1.2 and runs in a recess, extending in the offset direction of the print head 1, in the print-head holder 2. The angled plates 29 and 30 are disposed on the print-head holder 2 and each form a stop for the magnet 28 for limiting the print-head 1 movement transversely with respect to the first line. For this purpose, they each have a stop face 29.1 and 30.1, respectively.

The magnetic force which acts between the magnets 28 and the respective angled plate 29 or 30 constitutes the contact force which acts on the respective stop and which holds the print head 1 in the respective transverse position.

It goes without saying that, in other configurations, the angled plates 29, 30 or an element corresponding to these can also be configured as a magnet, and that then an appropriate element made of a soft magnetic material or the like is joined to the print head 1.

In the example shown, the printing operation has the following sequence. When the franking machine is switched on, the print head 1 is in a maintenance and park position, which in FIG. 2 is located to the right of the position indicated by the contour 1.5. First, it is then moved in the direction of the arrow 11 until it has reached its first longitudinal position, a first printed image being produced. It is then moved further in the direction of the arrow 11 until it reaches the guide pin 6.2. Due to the guide groove 6.5, it is then offset into its second transverse position while moving in the direction of the arrow 11. It is then moved in the direction of the arrow 12 as far as its second longitudinal position, producing a second printed image. In this case, the first and second printed image supplement each other to form a complete franking imprint. The printing operation is then concluded. The print head 1 is then offset into its first transverse position and either moved back into its park position again or a further franking imprint begins immediately.

Figure 3:
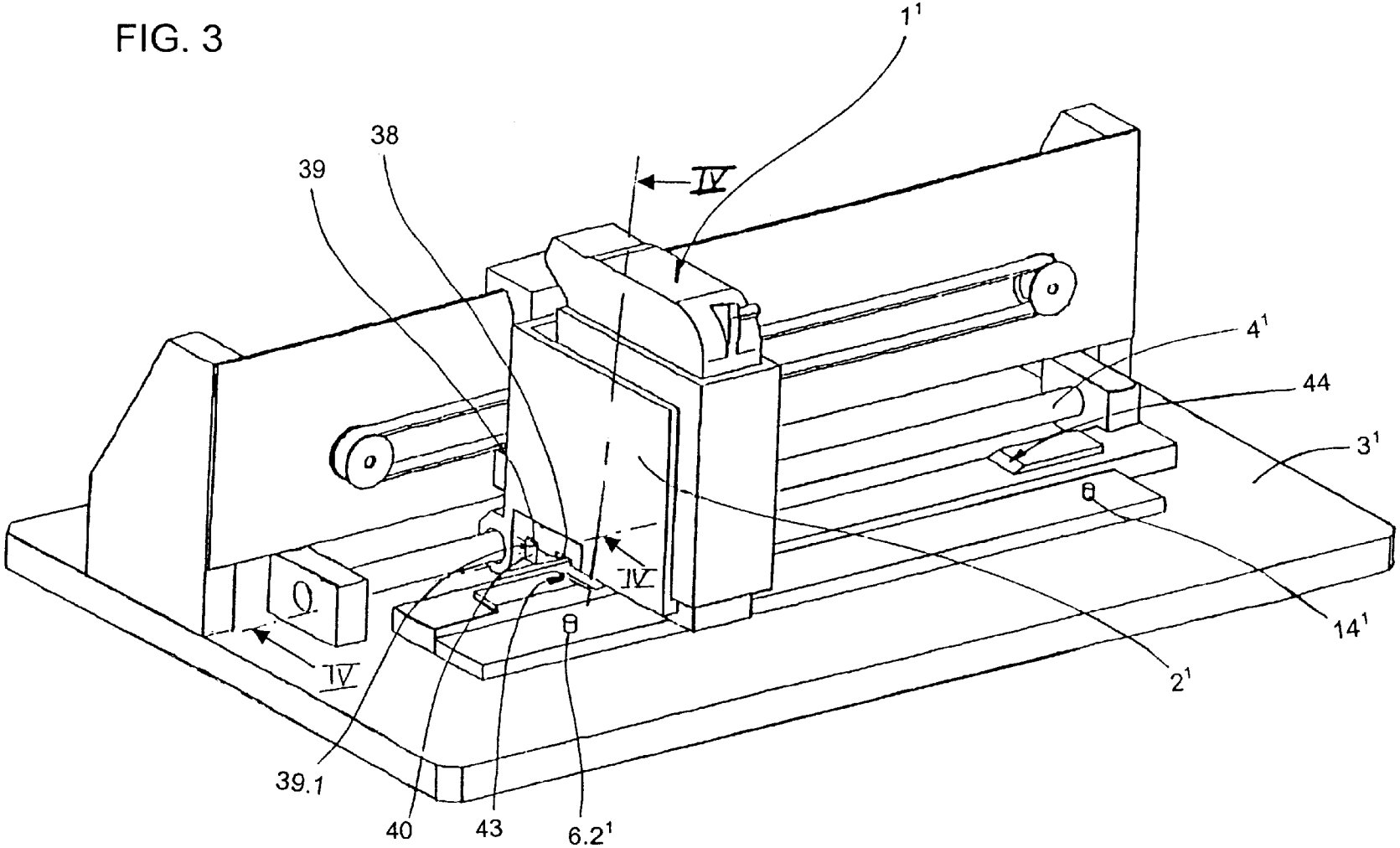
FIG. 3 is a perspective view of a second exemplary embodiment of the printing device.

FIG. 3 shows a perspective view of a further exemplary embodiment of the device according to the invention which, in terms of its basic construction, equates to that of FIG. 1, so that only the differences will be discussed here.

The difference resides in the configuration of the first and second holding devices. These are formed by grooves 38 and 39 disposed on a print-head holder 2' and a locking element 40 which, in order to hold the print head 1' positively in its respective transverse position, can engage in the respective grooves 38 or 39.

A print head 1' is held relative to the print-head holder 2' by mutually counteracting spring devices (not illustrated) if there is no action from other devices, such as the locking element etc., in a neutral position located in the center between the first and second transverse positions.

Figure 4:
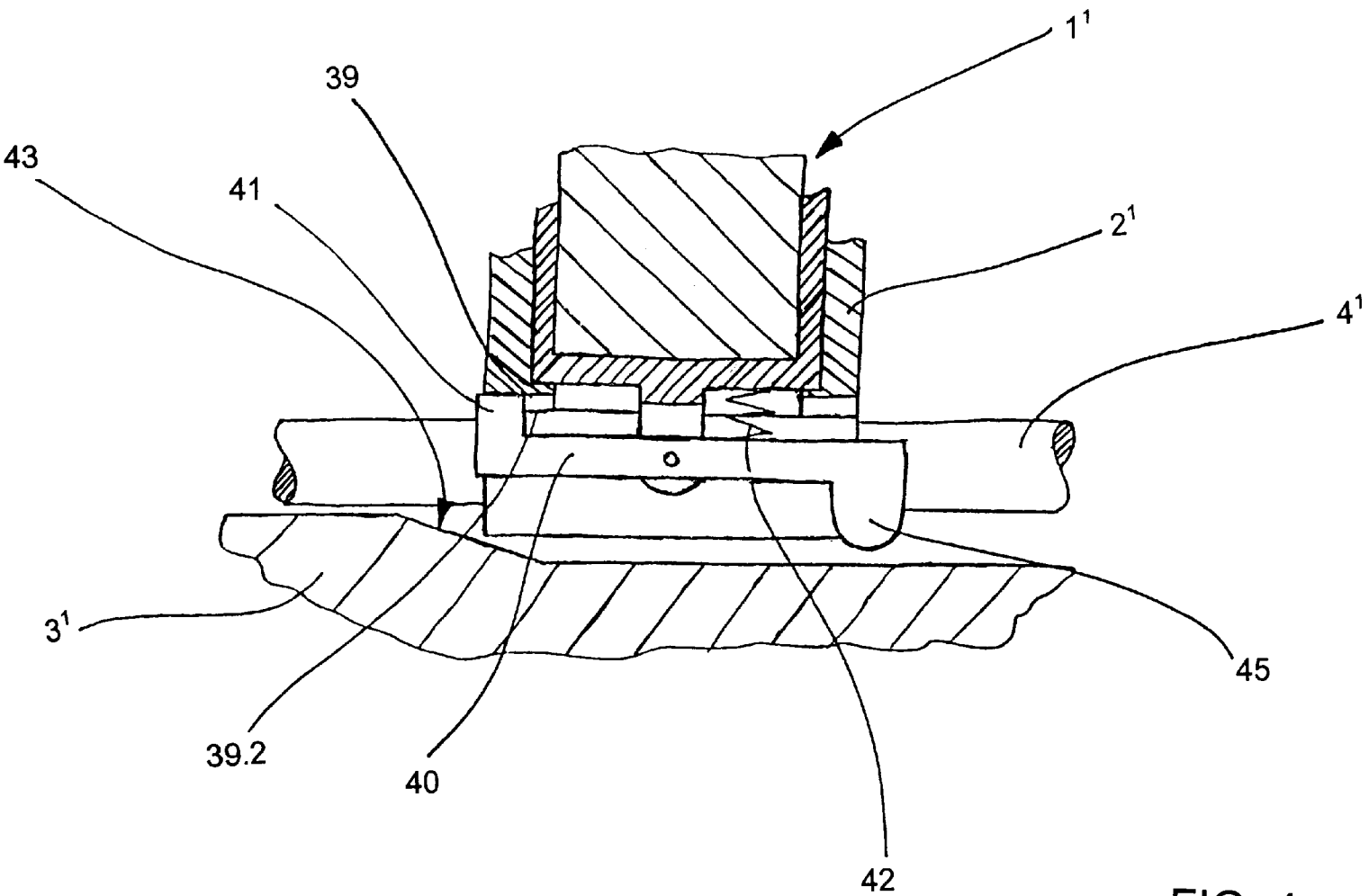
FIG. 4 is a partial sectional view taken along the line IV—IV shown in FIG. 3.

As can be gathered from FIG. 4, the locking element is a hook-like lever 40 which is attached to the underside of the print head 1' and whose first free end 41 engages into the groove 39 belonging to the second holding device 2'. A side face 39.1 of the groove 39 which is opposite a side face 39.2 forms a stop for the lever 40, which limits the transverse movement of the print head 1' transversely with respect to the first line.

The lever 40 is biased toward the print head 1' by a spring 42 in such a way that it is held in its engaged position in the groove 39 or 38. In order to be able to offset the print head 1' transversely with respect to the first line, the lever must be released from its engagement with the respective groove 38 or 39. This is done, as the print-head holder 2' is moved along the first line, by ramps 43 and 44 disposed on the base element 3' and against which the second free end 45 of the lever 40 runs. The ramps 43, 44 are disposed such that the lever 40 is only released from the respective groove 38 or 39 when the respective guide pin 6.2' or 14' is already engaged with the respective (not illustrated) guide groove for offsetting the print head 1' from its first transverse position into its second transverse position or from its second transverse position into its first transverse position.

This is done in order to ensure that the guide pin also actually comes into engagement with the relevant guide groove.

Once the print head has been offset into its other transverse position by the relevant guide groove, and once the second free end 45 of the lever 40 has run off the relevant ramp again, the first free end 41 of the lever 40 automatically engages with the other groove 39 or 38, thanks to the spring 42. The print head 1' is then held in its other transverse position.

It goes without saying that, in other variants, the lever 40 can also be disposed on the print-head holder 2' and the grooves on the print head 1'. In addition, it goes without saying that it is also possible to dispense with the spring devices for biasing the print head 1' against the print-head holder 2'. In this case, in order to position the print head 1' accurately in the respective position, it is then advantageous to provide an appropriately accurate fit between lever and grooves, in order to keep the play within a tolerable range during positioning.

In addition, it goes without saying that the variants for holding the print head in its transverse position can be combined with one another as desired. For example, the print head can be held in its first transverse position by a magnetic action and in its second position by an appropriate locking element, etc.

In all the above described exemplary embodiments, the offsetting device is configured such that an offset of the print head transversely with respect to the first line is achieved which is sufficiently great for the two printed images produced as the print-head holder is moved between the first and second longitudinal position and vice versa overlap at most in the marginal area in which they adjoin each other transversely with respect to the first line. Ideally, the result is no overlap. The two printed images supplement each other to form an overall imprint which, depending on the overlap, has about twice the dimension of the printed images transversely with respect to the first line.

In order to permit the simple adjustability of the geometric relationship between the guide pins 6.2, 14 and the grooves 6.5 and 6.3, the guide pin in the variant of FIG. 1 is disposed on a carrier 48 which is mounted in the base element 3 such that it can be adjusted transversely with respect to the first line. It goes without saying that, in other variants, both guide pins can also be mounted so as to be adjustable in this way.

Figure 2:
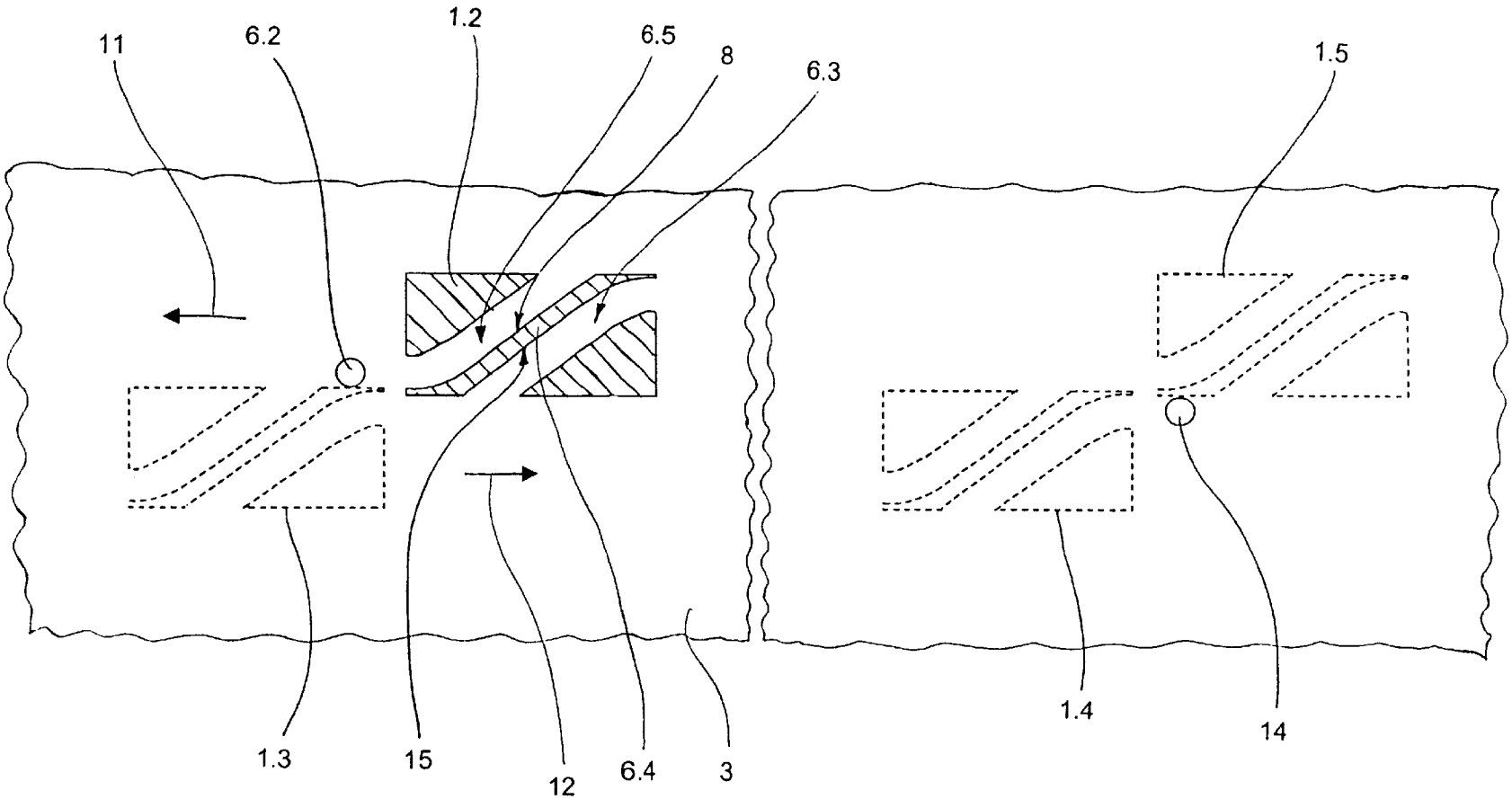
FIG. 2 is a partial, sectional view taken along the line II—II shown in FIG. 1 of a guide device of the printing device.
Figure 5:
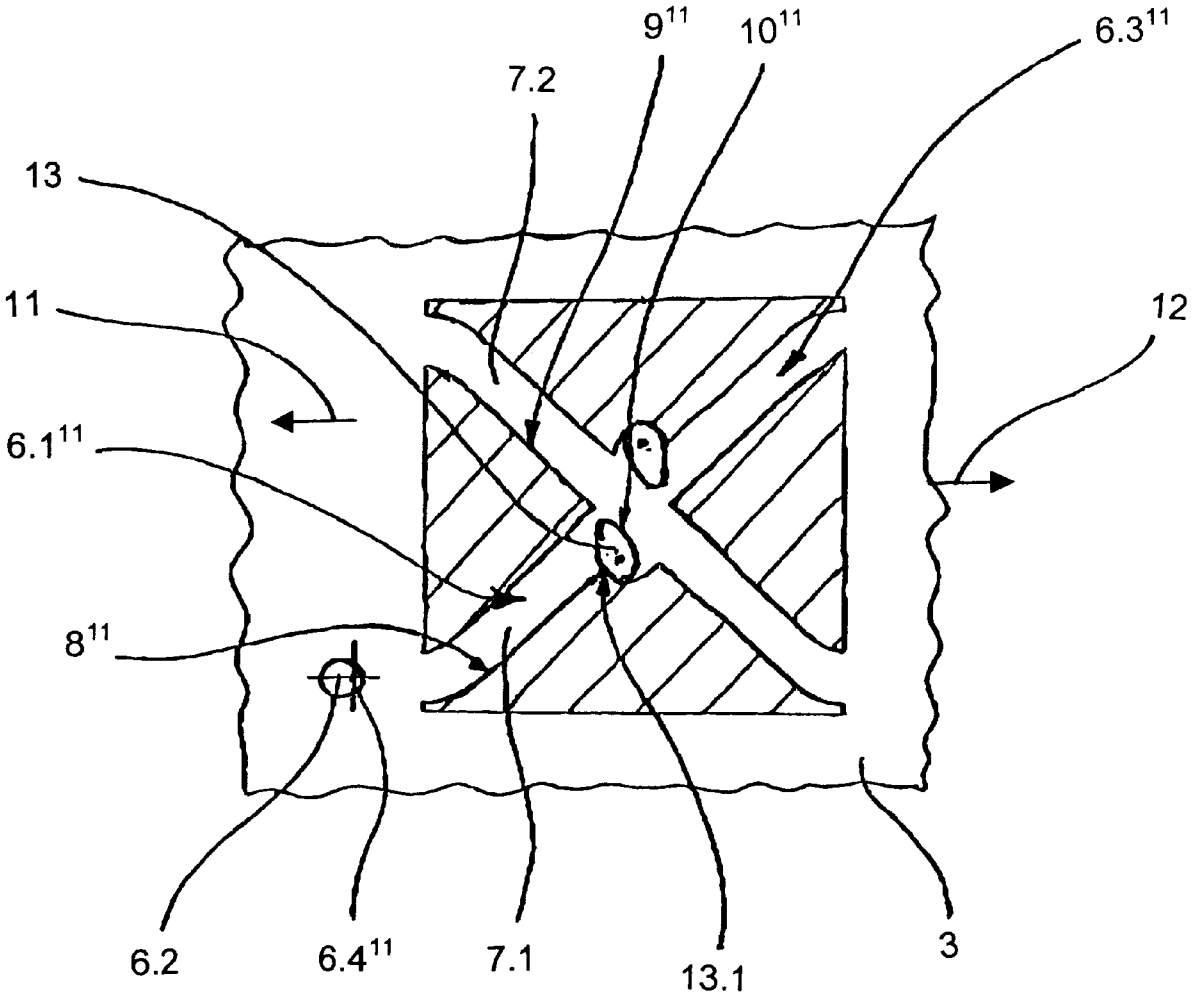
FIG. 5 is a partial sectional view through a further configuration of the guide device of the printing device.

FIG. 5 shows, similarly to FIG. 2, a schematic section through the first guide device of a further embodiment of the present invention. This variant differs from the variant described in relation to FIG. 1 only in the configuration of the first and second guide grooves, so that only this difference will be discussed here.

The difference resides in the fact that a guide groove 6.1" has a V-shaped course with a first leg 7.1 and a second leg 7.2, which run symmetrically with respect to an axis parallel to the first line. With its side walls, it provides first guide faces 8", 9" and 10", against which the guide pin 6.2 can run.

Because of the inclination between the guide face 8" and the first line, the guide groove 6.1" is moved transversely with respect to the first line toward the guide rod 4, counter to the bias force of the spring 5, as the print-head holder 2 is moved in the direction of the arrow 11. Since the guide groove 6.1" is firmly disposed on the shell 1.2, the print head 1 is also moved with it from its first transverse position, transversely with respect to the first line.

Once the guide pin 6.2 has traveled through the first leg 7.1", and therefore, after half the transverse offset to be completed, has reached the guide face 9" the direction of movement along the first line is reversed, that is to say the print-head holder 2 is moved in the direction of the arrow 12.

In order to ensure that the guide pin 6.2 does not enter the first leg 7.1" again, the guide device 13 is disposed in the transition area of the legs 7.1 and 7.2 of the guide groove 6.1", ensuring the offsetting movement of the print head 1 from the first into the second transverse position.

The guide device 13 can be embodied as a diverter 13 which is disposed such that it can be pivoted and is biased against a stop 13.1 by a spring device (not shown), so that in the normal state it closes the first leg 7.1. When the print-head holder 2 is moved in the direction of the arrow 11, the guide pin 6.2 forces the diverter 13 out of the first leg 7.1 and can therefore pass the diverter 13.

After the diverter 13 has been passed, because of its bias the latter moves into its normal position again, in which it closes the first leg 7.1 and opens the second leg 7.2. After the movement of the print-head holder 2 has been reversed, as the print-head holder 2 is moved in the direction of the arrow 12, the guide pin 6.2 offsets the print head 1 further transversely with respect to the first line, by the guide face 10" disposed on the diverter 13 and inclined with respect to the first line, and the guide face 9", until it reaches its second transverse position at the end of the guide face 9".

It goes without saying that the guide device 13 can also be configured in another way in other variants of the device according to the invention. For example, it is possible to implement the diverter 13 as a resiliently deformable projection or the like in the guide groove instead of as a separate component.

In order to offset the print head 1 back from the second transverse position into the first transverse position, there is in the area of the second longitudinal position of the print-head holder 2 a second guide groove 6.3", which cooperates with the second guide pin 14 in the manner just described.

The guide pin 6.2 can have an axis of rotation 6.4" offset from the center line of the guide pin 6.2. With such a configuration, the guide pin 6.2 may act as an eccentric for adjustment of its transverse position with respect to the groove.

The above described exemplary embodiment are in each case restricted to offsetting devices which provide the offset and reverse offset of the print head between a first and a second transverse position. However, it goes without saying that further offsetting devices of the type described can also be provided in order to offset the print head transversely with respect to the first line between more than two transverse positions. In this case, they can be disposed such that the print head completes a serpentine or meandering movement during the printing of more than two printed images adjoining one another transversely with respect to the first line. In order to return to the starting position, either a separate offsetting device can be provided, or the offset path can be traveled through in the opposite direction.

Figure 6:
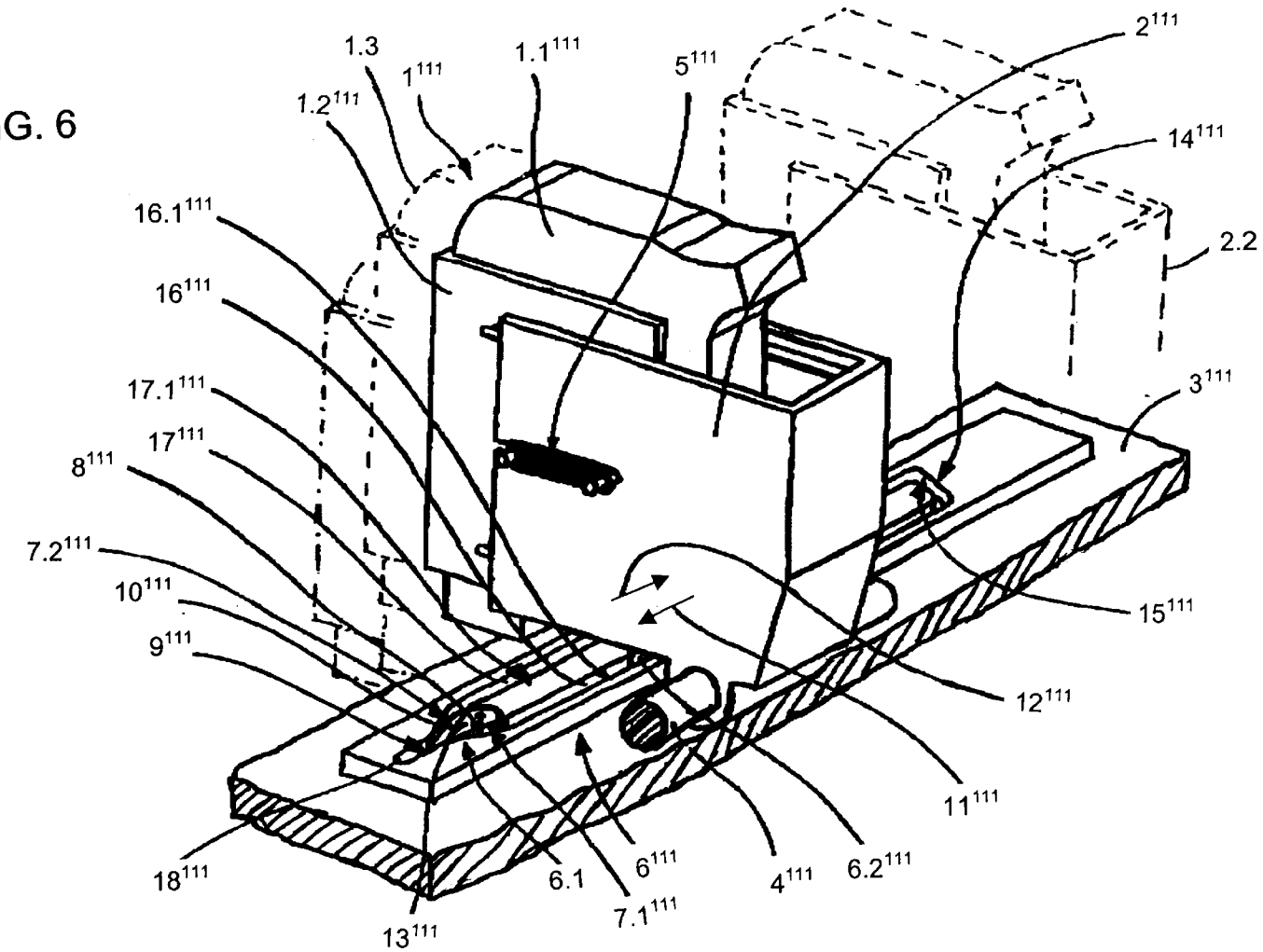
FIG. 6 is a perspective view of a third embodiment of the printing device.
Figure 7:
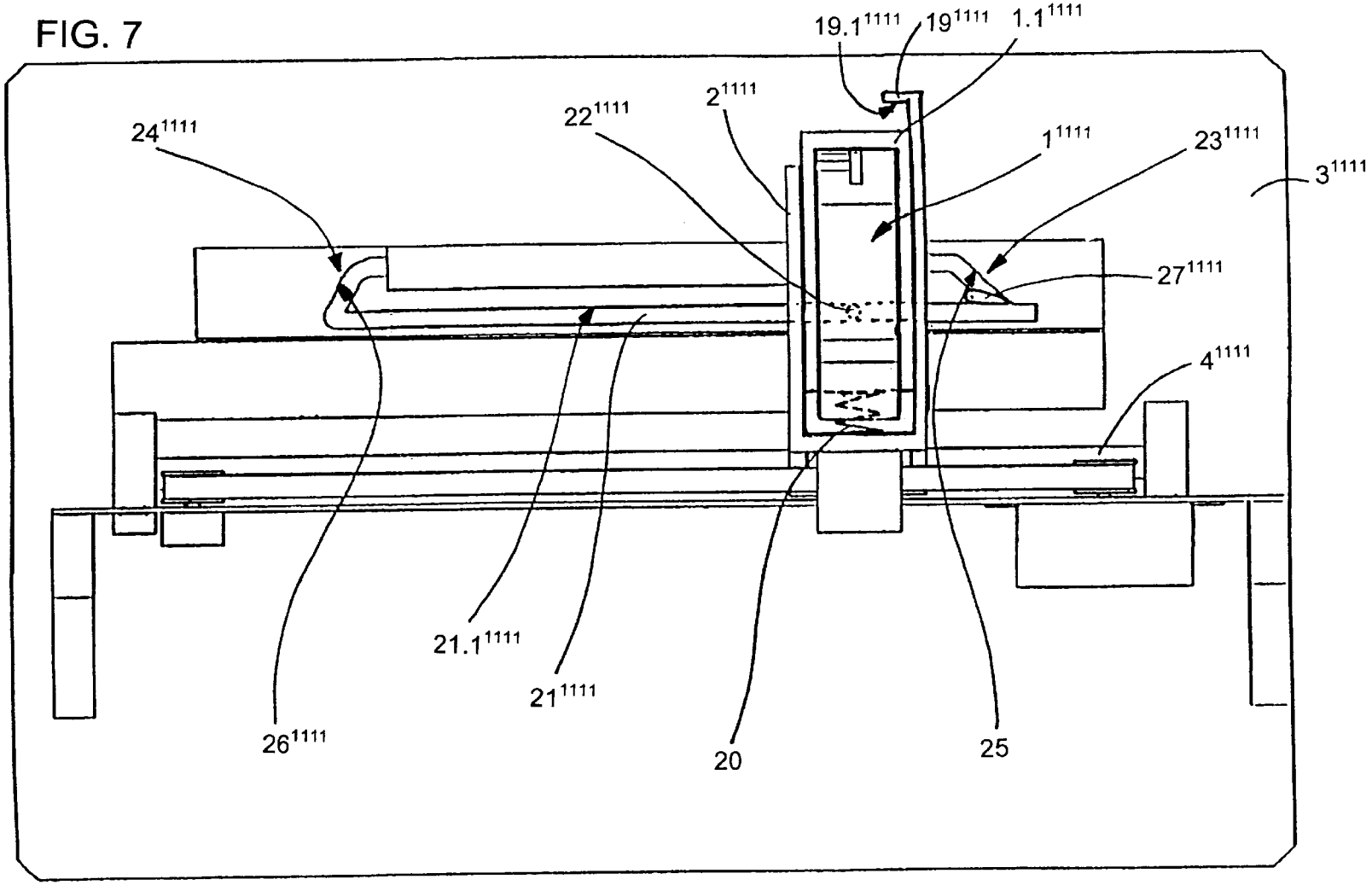
FIG. 7 is a top plan view of a fourth embodiment of the printing device.
Figure 8:
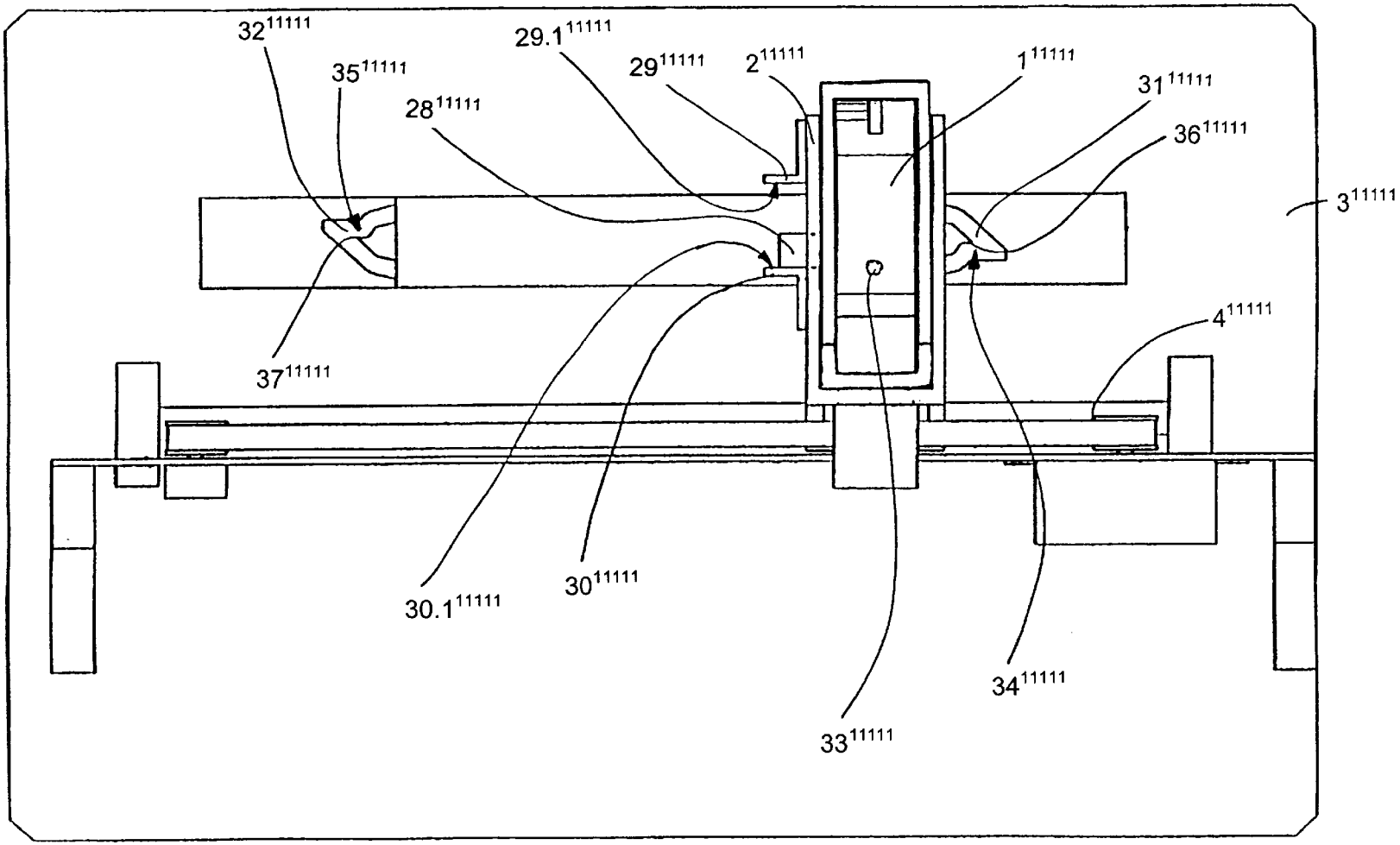
FIG. 8 is a top plan view of a fifth embodiment of the printing device.

FIGS. 6 to 8 show alternative configurations, in which the guide pin is joined to the print head. With these configurations, the above described advantages can be achieved in the same way.

FIG. 6 shows a partial view of a franking machine having a print head 1'", which is held displaceably on a print-head holder 2'". In this case, the print head 1'" includes an ink jet cartridge 1.1'", which is replaceably mounted in a shell 1.2'". The shell 1.2'" is mounted displaceably in the print-head holder 2'".

During printing, the print-head holder 2'" is moved along a first line with respect to base element 3'", between a first longitudinal position and a second longitudinal position (as shown by the dashed line contour 2.2 of the print-head holder 2'" at the second longitudinal position), which achieves the relative movement between the print head 1'"

and a medium to be printed (not illustrated). In the process, it is guided by a guide rod 4''', of which only a section is shown.

The print head 1''' is mounted in the print-head holder 2''' by the shell 1.2''' such that it can be displaced transversely with respect to the first line. In this case, it is joined to the print-head holder 2''' by a spring 5''', which exerts on it a prestressing force acting in the direction of the guide rod 4'''.

In addition, a first offsetting device 6''' is provided. The first offsetting device 6''' is used to offset the print head 1''' relative to the print-head holder 2''' from a first transverse position into a second transverse position spaced apart from the first transverse position transversely with respect to the first line (note the dashed line contour 1.3 of the print head 1''' at the second transverse position). This makes it possible to print printed images that are offset from each other transversely with respect to the first line.

The first offsetting device 6''' is formed by a first guide device 6.1''' and a second guide device 6.2'''. The first guide device is a guide groove 6.1''' in the base element 3'''. The second guide device is a guide pin 6.2''', which is disposed on the underside of the shell 1.2''' and can run in the guide groove 6.1'''.

The guide groove 6.1''' and the guide pin 6.2''' cooperate in the following way as the print-head holder 2''', and therefore the print head 1''', is moved along the first line, with mutual relative movement, in order to offset the print head 1''' transversely with respect to the first line.

The guide groove 6.1''' has a Y-shaped course with a first leg 7.1''' and a second leg 7.2''', which run symmetrically with respect to an axis parallel to the first line. With its side walls, it provides first guide faces 8''', 9''' and 10''', against which the guide pin 6.2''' is pressed as a result of the bias force exerted by the spring 5'''.

Because of the inclination between the guide face 8''' and the first line, the guide pin 6.2''' is moved away from the guide rod 4''' transversely with respect to the first line and counter to the bias force of the spring 5''' as the print-head holder 2''' is moved in the direction of an arrow 11'''. Since the guide pin 6.2''' is firmly fixed to the shell 1.2''', the print head 1''' is also offset with it from its first transverse position, transversely with respect to the first line.

Once the guide pin 6.2''' has traveled through the first leg 7.1''' and therefore, after half the transverse offset to be completed, has reached the guide face 9''', the direction of movement along the first line is reversed, that is to say the print-head holder 2''' is moved in the direction of the arrow 12'''.

In order to ensure that the guide pin 6.2''' does not move in the first leg 7.1''' again, a guide device 13''' is disposed in the transition region of the legs 7.1''' and 7.2''' of the guide groove 6.1''' and ensures the offsetting movement of the print head 1''' from the first into the second transverse position.

The guide device is embodied as a diverter 13''' which is disposed such that it can be pivoted and is biased against the guide face 8''' by a spring device (not shown), so that in the normal state it closes the first leg 7.1'''. When the print-head holder 2''' is moved in the direction of the arrow 11''', the guide pin 6.2''' forces the diverter 13''' out of the first leg 7.1''' and can therefore pass the diverter 13'''.

After the diverter 13''' has been passed, the latter moves back, because of its bias, into its normal position again, in which it closes the first leg 7.1''' and opens the second leg 7.2'''. After the movement of the print-head holder 2''' has been reversed, as the print-head holder 2''' is moved in the direction of the arrow 12''', the guide pin 6.2''', and with it the print head 1''', is offset further transversely with respect to the first line by the guide face 10''' which is for the most part disposed on the diverter 13''' and inclined with respect to the first line, until it reaches its second transverse position at the end of the guide face 10'''.

It goes without saying that the diverter device 13''' can also be configured in another way in other variants. For example, it is possible to implement the diverter 13''' as a resiliently deformable projection or the like in the guide groove instead of as a separate component.

A guide groove 5''' is disposed in the area of a first longitudinal position of the print-head holder, so that the transverse offsetting of the print head can be carried out directly after the completion of a printed image or before the beginning of a printed image.

In order to offset the print head 1''' back from the second transverse position into the first transverse position, a second offsetting device is provided in the area of the second longitudinal position of the print-head holder 2'''. The second offsetting device is followed by a third guide device in the form of a second guide groove 14''', in which again the guide pin 6.2''' can run.

The guide groove 14''' has a guide face 15''' against which the guide pin 6.2''' is pressed because of the biasing by the spring 5'''. Here, too, the print head is offset as a result of the inclination of the guide face 15''' with respect to the first line, by moving the print-head holder 2''' along the first line.

It goes without saying that, in other variants, other guide devices can be provided instead of the guide grooves and guide pins.

In order to hold the print head 1''' in its first or second transverse position during printing, that is to say while traveling between the first and second longitudinal position and vice versa, holding devices are provided. These are formed by a first holding device in the form of a first longitudinal guide groove 16''' and a second holding device in the form of a second longitudinal guide groove 17'''. These are disposed on the base element 3''', adjoining the two guide grooves 6.1''' and 14'''. The guide pin 6.2''' can run in them.

The two longitudinal guide grooves 16''' and 17''' run parallel to the first line. They each have a longitudinal guide face 16.1''' and 17.1''' parallel to the first line, against which the guide pin 6.2''' acting as a longitudinal guide element is forced by the bias of the spring 5''' as it runs through the respective longitudinal guide groove 16''' or 17'''. The longitudinal guide faces 16.1''' and 17.1''' thus each form a first stop for limiting the print-head movement transversely with respect to the first line.

Because of the parallelism of the respective longitudinal guide face 16.1''' and 17.1''' to the first line, when the print-head holder 2''' is moved between the first and second longitudinal position or vice versa, the print head is guided parallel to the first line and, as a result, is held in its respective transverse position during printing.

In the example shown, the printing operation has the following sequence. When the franking machine is switched on, the print head 1''' is in its maintenance and park position, in which the guide pin 6.2''' is located at an end 18 of the Y-shaped guide groove 6.1'''. It is then moved in the direction of the arrow 12''', until the print head 1''' has reached its second transverse position and the first longitudinal position. It is then moved further as far as the second longitudinal position, a first printed image being produced. It is then moved further in the direction of the arrow 12''' until it reaches the guide groove 14'''. Due to the guide groove 14''', it is then offset into its first transverse position and then moves in the direction of the arrow 11'''. As soon as it has reached its second longitudinal position again, it is moved onward as far as its first longitudinal position, producing a second printed image. The first and second printed images supplement each other to form a complete franking imprint. The printing operation is then concluded. The print head 1''' is then moved either into its park position again or, with the aid of the guide groove 6.1''', offset into its second transverse position again, in order to begin a new franking imprint.

FIG. 7 shows a plan view of a further alternative configuration which, in its basic construction, equates to that of FIG. 6, so that only the differences will be discussed here.

One difference consists in the configuration of the first holding device, which is formed by a simple stop 19'''', which is disposed on the print-head holder 2''''. The stop 19'''' provides a stop face 19.1'''' for the shell 1.1'''', and therefore limits the print-head movement transversely with respect to the first line.

The first holding device further contains a spring configuration formed by a spring 20'''' (shown schematically), which exerts on the print head 1'''' a force directed away from the guide rod 4''''. When the print head 1'''' is resting on the stop face 19.1'''' of the stop 19'''', then the spring 20'''' produces a contact force on the stop 19'''', which holds the print head in its first transverse position.

The second holding device is again formed by a longitudinal guide groove 21'''' which, as a stop for limiting the print-head movement transversely with respect to the first line, forms a longitudinal guide face 21.1'''' parallel to the first line for the guide pin 22'''' disposed on the underside of the print head 1''''. Here, too, the spring 20'''' provides a contact force between longitudinal guide face 21.1'''' and guide pin 22'''', which holds the print head 1'''' in its second transverse position.

It goes without saying that, in other configurations of the device, the stop can also be disposed at another point and in another configuration on the print-head holder.

A further difference from the configuration shown in FIG. 6 consists in the configuration of guide grooves 23'''' and 24'''', which cooperate with a guide pin 22'''' in order to offset the print head 1'''' from its first transverse position into its second transverse position and from its second transverse position into its first transverse position. The guide grooves each have only one guide face 25'''' and 26'''' running at an angle to the first line to offset the print head 1'''' transversely, against which faces the guide pins 22'''' is biased by the spring 20''''. In the area of the first guide groove 23'''', a diverter 27'''' is again provided, which corresponds in terms of its function to the diverter 13''' from FIG. 6.

FIG. 8 shows a plan view of a further alternative configuration, which in its basic construction equates to that of FIG. 6, so that here, too, only the differences will be discussed.

One difference resides here in the configuration of the first and second holding devices. They are formed by a magnet 28''''' and two angled plates 29''''' and 30''''' made of a magnetic metal. The magnet 28''''' is joined to the print head 1''''' and runs in a recess extending in the offset direction of a print head 1''''' in a print-head holder 2'''''. The angled plates 29''''' and 30''''' are disposed on a print-head holder 2''''' and each form a stop for the magnet 28''''' in order to limit the print-head movement transversely with respect to the first line. For this purpose, they each have a stop face 29.1''''' and 30.1''''', respectively.

The magnetic force which acts between the magnet 28''''' and the respective angled plate 29''''' or 30''''' provides a contact force which acts on the respective stop and holds the print head in the respective transverse position.

It goes without saying that, in other configurations, the angled plates or an element corresponding to these can also be configured as a magnet, and that an appropriate element made of a soft magnet metal or the like is joined to the print head.

A further difference lies in the guide grooves 31''''' and 32''''', which cooperate with the guide pin 33''''' disposed on the underside of the print head 1''''' in order to offset the print head 1''''' from its first transverse position into its second transverse position and from its second transverse position into its first transverse position.

The guide grooves 31''''' and 32''''' are substantially V-shaped. In the transition area of their legs, they have a guide device 34''''' or 35''''', which ensures that the print head 1''''', as it is moved along the first line, is offset from its first transverse position into its second transverse position or from its second transverse position into its first transverse position.

In this case, the guide device 34''''' and 35''''' has a run-on area 36''''' and 37''''', which is offset in the direction opposite the respective offsetting direction of the print head 1''''' with respect to the transverse position which the print head 1''''' has reached as it travels along the first line at the time of the reversal of the travel movement along the first line. Since, in the present variant, the print head 1''''' is not biased against the print-head holder 2''''' by any spring device or the like, it remains in the transverse position during the reversal of movement and subsequently runs against the respective run-on area 36''''' or 37'''''.

In order to reduce the influence of any shocks or the like, a frictional force counteracting the relative movement can act as a result of the selected fit between the print head 1''''' and the print-head holder 2''''''. Likewise, the print head 1''''' can be kept in the transverse position relative to the print-head holder 2''''', as a neutral position, by mutually counteracting spring devices or the like.

It goes without saying that the offset of the run-on edges formed by the run-on area 36''''' or 37''''' for the guide pin 33''''' relative to the transverse position of the guide pin 33''''' in the relative transverse position only has to be sufficiently large that, following the reversal of direction, the guide pin is deflected further in the desired offsetting direction of the print head 1''''' by the relevant run-on edge.

We claim:

1. A printing device, comprising:

a base element;

a print head;

a print-head holder displaceably holding said print head, in order to achieve a relative movement between said print head and a medium to be printed, said print-head holder configured to be moved along an imaginary line between a first longitudinal position and a second longitudinal position positioned above said base element; and an offsetting device permitting the printing of printed images with a transverse offset from one another transversely with respect to the imaginary line, said offsetting device configured to offset said print head relative to said print-head holder from a first transverse position to a second transverse position spaced apart from the first transverse position, and transversely with respect to the imaginary line, said offsetting device including a first guide device with a guide groove having limbs and a second guide device with a guide element, said first guide device and said second guide device cooperating, with mutual relative movement, for offsetting said print head from the first transverse position to the second transverse position by moving said print-head holder along the imaginary line, said guide groove of said first guide device having one of a substantially V-shaped and a substantially Y-shaped course, said limbs of said guide groove being inclined with respect to the imaginary line and intersecting in a transverse direction at half of the transverse offset.

2. The printing device according to claim 1, wherein said guide groove is formed in said base element, and said second guide device is a guide pin.

3. The device according to claim 2, wherein said guide pin has a circularly cylindrical operative face.

4. The device according to claim 1, wherein said second guide device is disposed on said base element such that its position can be adjusted transversely with respect to the imaginary line.

5. The device according to claim 4, wherein in order to achieve a positional adjustment, said second guide device is configured as an eccentric.

6. The device according to claim 1, wherein said second guide device is disposed on said base element in an area of one of the first longitudinal position and the second longitudinal position of said print-head holder.

7. The device according to claim 1, including a further offsetting device for offsetting said print head from the second transverse position to the first transverse position and disposed on said base element.

8. The device according to claim 7, wherein said further offsetting device is configured to offset said print head from the second transverse position to the first transverse position by moving said print-head holder along the imaginary line.

9. The device according to claim 8, wherein said further offsetting device contains a third guide device.

10. The device according to claim 9, wherein said third guide device is configured to cooperate with said first guide device belonging to said offsetting device.

11. The device according to claim 1, wherein the printing device is a franking machine.

12. The device according to claim 1, wherein said second guide device is disposed on said base element.

13. The device according to claim 12, wherein said second guide device is a guide pin.

14. The device according to claim 13, wherein said guide pin has a circularly cylindrical operative face.

* * * * *